US011007106B2

(12) United States Patent
Zhu et al.

(10) Patent No.: US 11,007,106 B2
(45) Date of Patent: May 18, 2021

(54) POSTOPERATIVE FUNCTIONAL EXERCISER FOR FROZEN SHOULDER

(71) Applicant: SHENZHEN SECOND PEOPLE'S HOSPITAL, Shenzhen (CN)

(72) Inventors: Weimin Zhu, Shenzhen (CN); Daping Wang, Shenzhen (CN); Jianyi Xiong, Shenzhen (CN); Wei Lu, Shenzhen (CN); Jiaming Cui, Shenzhen (CN); Kang Chen, Shenzhen (CN); Liangquan Peng, Shenzhen (CN)

(73) Assignee: SHENZHEN SECOND PEOPLE'S HOSPITAL, Shenzhen (CN)

( * ) Notice: Subject to any disclaimer, the term of this patent is extended or adjusted under 35 U.S.C. 154(b) by 200 days.

(21) Appl. No.: 16/120,064

(22) Filed: Aug. 31, 2018

(65) Prior Publication Data

US 2018/0369055 A1 Dec. 27, 2018

Related U.S. Application Data

(63) Continuation of application No. PCT/CN2017/076105, filed on Mar. 9, 2017.

(30) Foreign Application Priority Data

Mar. 29, 2016 (CN) ..... 201610187577.7

(51) Int. Cl.
*A61H 1/00* (2006.01)
*A61H 1/02* (2006.01)

(52) U.S. Cl.
CPC ..... *A61H 1/0281* (2013.01); *A61H 1/00* (2013.01); *A61H 1/02* (2013.01);
(Continued)

(58) Field of Classification Search
CPC ..... A61H 2205/06; A61H 2205/062; A61H 1/0277; A61H 1/0274; G08L 9/0038; A63B 69/36
(Continued)

(56) References Cited

U.S. PATENT DOCUMENTS 5,188,365 A * 2/1993 Picard ..... A63B 69/0059 473/212
6,027,413 A * 2/2000 Smith ..... A63B 69/0059 473/212
(Continued)

FOREIGN PATENT DOCUMENTS

CN 101909555 A 12/2010
CN 203252782 U 10/2013
(Continued)

*Primary Examiner* — Jan Christopher L Merene
*Assistant Examiner* — Matthew Standard

(57) ABSTRACT

Disclosed is a postoperative functional exerciser for frozen shoulder. The exerciser includes a hand push rod (1) and a restrictive band (2) for restricting the elbow. The hand push rod (1) comprises a wristband (11) and a push rod (12). One end of the push rod (12) is connected with the wristband (11). When the hand push rod (1) and the restrictive band (2) are in operation, a part of the restrictive band (2) winds around the elbow joint of an affected arm, the other part winds around a waist buckle (3) at a waist portion of the restrictive band (2) on a side opposite to the affected arm, and the wristband (11) is sleeved on the wrist of the affected arm. The upper arm is tied to the body by means of the restrictive band (2).

13 Claims, 9 Drawing Sheets

(52) U.S. Cl.
CPC ..... *A61H 2201/0157* (2013.01); *A61H 2201/0192* (2013.01); *A61H 2201/1276* (2013.01); *A61H 2201/163* (2013.01); *A61H 2201/1638* (2013.01); *A61H 2201/1652* (2013.01); *A61H 2205/062* (2013.01)

(58) Field of Classification Search
USPC ..... 601/5; 434/252
See application file for complete search history.

(56) References Cited

U.S. PATENT DOCUMENTS 6,516,821 B1 * 2/2003 Uemura ..... A45B 9/00 135/139
6,689,030 B1 * 2/2004 Leslie ..... A61H 1/0281 482/139
7,717,834 B2 * 5/2010 Kay ..... A61H 1/0281 482/124
2003/0130600 A1 7/2003 Branch
2003/0223844 A1 12/2003 Schiele et al.
2007/0129657 A1 * 6/2007 Fisher ..... A61F 5/3738 602/4
2008/0312053 A1 12/2008 Kay
2010/0010396 A1 1/2010 Branch
2010/0144503 A1 6/2010 Kay
2011/0046529 A1 * 2/2011 Vollbrecht ..... A61F 5/3753 602/20
2016/0074205 A1 * 3/2016 Yao ..... A61F 5/3738 602/4

FOREIGN PATENT DOCUMENTS

CN 104069613 A 10/2014
CN 104519840 A 4/2015
CN 105640741 A 6/2016
CN 205494318 U 8/2016
DE 19731358 A1 2/1999

* cited by examiner

POSTOPERATIVE FUNCTIONAL EXERCISER FOR FROZEN SHOULDER

CROSS-REFERENCE TO RELATED APPLICATIONS

This application is a continuation of International Application No. PCT/CN2017/076105 with a filing date of Mar. 9, 2017, designating the United States, now pending, and further claims to Chinese application No. 201610187577.7 with a filing date of Mar. 29, 2016. The content of the aforementioned applications, including any intervening amendments thereto, are incorporated herein by reference.

TECHNICAL FIELD

The present invention relates to a medical rehabilitation device, and particularly, to a postoperative functional exerciser for frozen shoulder.

BACKGROUND frozen shoulder, is a disease characterized by cystic inflammatory adhesion and stiffness of shoulder and glenohumeral joints, pain of shoulder joint and limited movement in all directions (especially abduction, external rotation and rear protraction) and caused by a variety of diseases. According to disease characters, the frozen shoulder can be classified into primary frozen shoulder and secondary frozen shoulder. The primary frozen shoulder is also known as idiopathic frozen shoulder, and its exact cause is unclear. At present, a large number of studies focus on the clinical symptomatic treatment of the frozen shoulder, and treatment effects are quite different. The common clinical treatment mode is to arthroscopically release the intra-articular adhesions through operations.

Success or failure of arthroscopic release operations not only depends on the operating techniques of operators, but also depends on postoperative functional exercise modes. Effective postoperative exercise not only facilitates the recovery of the activity of the shoulder joint, but also facilitates the improvement of the muscle strength of the shoulder joint. Therefore, postoperative functional exercise is of vital importance. Since the main clinical manifestations of the frozen shoulder are external rotation pain and external rotation dysfunction of patients, the main purpose of the postoperative exercise is to exercise the external rotation function.

At present, there is no special rehabilitation equipment for postoperative frozen shoulder, and only large-scale comprehensive rehabilitation equipment purchased by hospitals can be used for functional exercise. Meanwhile, the large-scale rehabilitation equipment has expensive price and poor portability. After returning home, the patients lose the exercise equipment and cannot use the rehabilitation equipment for the functional exercise.

Technical Problem

For most patients with frozen shoulder, the first thing to be solved is the recovery of the external rotation function after shoulder joint operation. Moreover, the rehabilitation equipment with relative portability and low cost is needed so that the patients exercise rehabilitation actions informed by doctors at home.

Technical Solutions

To solve the problems of poor portability and expensive price of a rehabilitation device for frozen shoulder in the prior art, the present invention provides a postoperative functional exerciser for frozen shoulder with simple structure, good portability and applicability to exercise of outward swing function of shoulder joints.

The technical solution of the present invention is as follows:

A postoperative functional exerciser for frozen shoulder comprises a hand push rod, a restrictive band for restricting the elbow, and a waist buckle for fixing the restrictive band, wherein the waist buckle is arranged on the waist on a side opposite to an affected arm; the hand push rod comprises a wristband and a push rod; one end of the push rod is connected with the wristband; when the hand push rod and the restrictive band are in operation, a part of the restrictive band winds around the side opposite to the affected arm and penetrates through the waist buckle, and the other part winds around the elbow joint of the affected arm; the elbow joint of the affected arm is tied to an outer side of a rib of a body; and the wristband is sleeved on the wrist of the affected arm.

A waistband is arranged; the waistband winds around the body and is tied to the waist; and the waistband penetrates through the waist buckle.

The push rod is provided with a buckle; the wristband is provided with a buckle ring; and the buckle is fastened with the buckle ring.

A rotating member is arranged; one end of the rotating member is rotatably connected with the wristband, and the other end is provided with an installing hole; and the buckle ring is arranged in the installing hole.

The wristband is of a banded structure; both ends of the banded structure are respectively provided with buckling structures which are matched with each other; and both ends of the banded structure are connected into a ring through the buckling structures.

The restrictive band is of a banded structure; both ends of the banded structure are respectively provided with buckling structures which are matched with each other; and both ends of the banded structure are buckled into a ring through the buckling structures.

The buckling structures are velcro arranged on both ends of the banded structure respectively.

The buckling structures comprise an adjusting hole formed at one end of the banded structure and an adjusting buckle arranged at the other end of the banded structure; and the adjusting buckle is buckled in the adjusting hole.

The banded structure is flexible material.

The push rod comprises a plurality of telescopic sections; a head and a tail of adjacent telescopic sections can be connected flexibly; and the adjacent telescopic sections are provided with a positioning structure for positioning a telescopic state.

Beneficial Effects of the Invention

The present invention only comprises the restrictive band and the hand push rod. A part of the restrictive band penetrates through the waist buckle on a side of the waist of the patient, and the other part of the restrictive band winds around the elbow joint of the affected arm. The upper arm is tied to the body by means of the restrictive band, so that the elbow and the upper arm cling to an outer edge of the rib of the patient. The wristband is sleeved on the wrist or forearm of the affected arm. Another person or the patient drags the wristband through the push rod by using a non-affected arm, so as to drive the forearm to swing outwards.

Compared with the prior art, ordinary patients have the economic ability to purchase the functional exerciser of the present invention, and can carry the functional exerciser of the present invention. The present invention allows the patients to receive postoperative rehabilitation exercise of the frozen shoulder without the limitations of economic capability, time and locations, makes the special rehabilitation of shoulder joint and frozen shoulder operations possible, has far-reaching significance for the development of arthroscopic radical operation of frozen shoulder, and is of great scientific significance to enrich and improve the existing medical rehabilitation equipment and lead the technological progress of relevant research fields.

1 hand push rod; 2 restrictive band; 3 waist buckle; 4 waistband; 11 wristband; 12 push rod; 111 buckle ring; 112 rotating member; 113 rotating seat; 114 velcro; 115 adjusting buckle; 116 adjusting hole; 121 buckle; 122 torsional spring; 123 pressure spring; 124 sliding groove; 1121 disk; 1131 rotating cavity; 1151 buckling frame; and 1152 buckling rod.

OPTIMAL EMBODIMENTS OF THE INVENTION

To make the purpose, the technical solutions and the advantages of the present invention more clear, the present invention is further described in detail below in combination with drawings and embodiments. It should be understood that specific embodiments described herein are only used for explaining the present invention, not for limiting the present invention.

Embodiment 1

Figure 1:
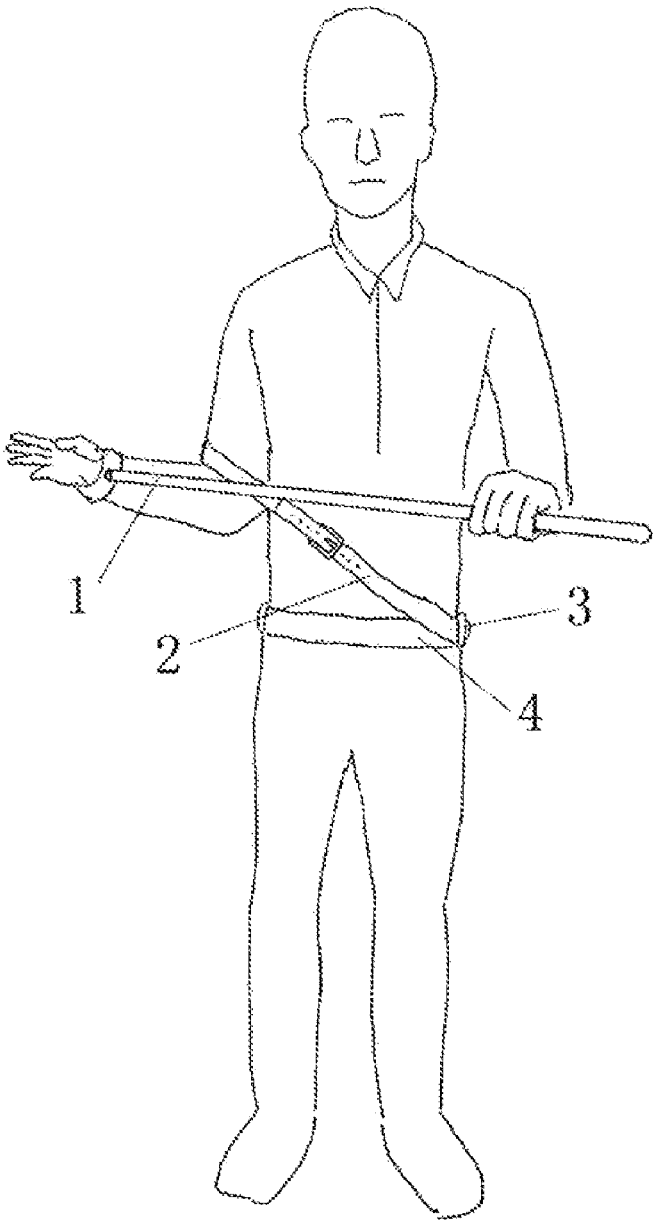
FIG. 1 is a working schematic diagram of embodiment 1.
Figure 2:
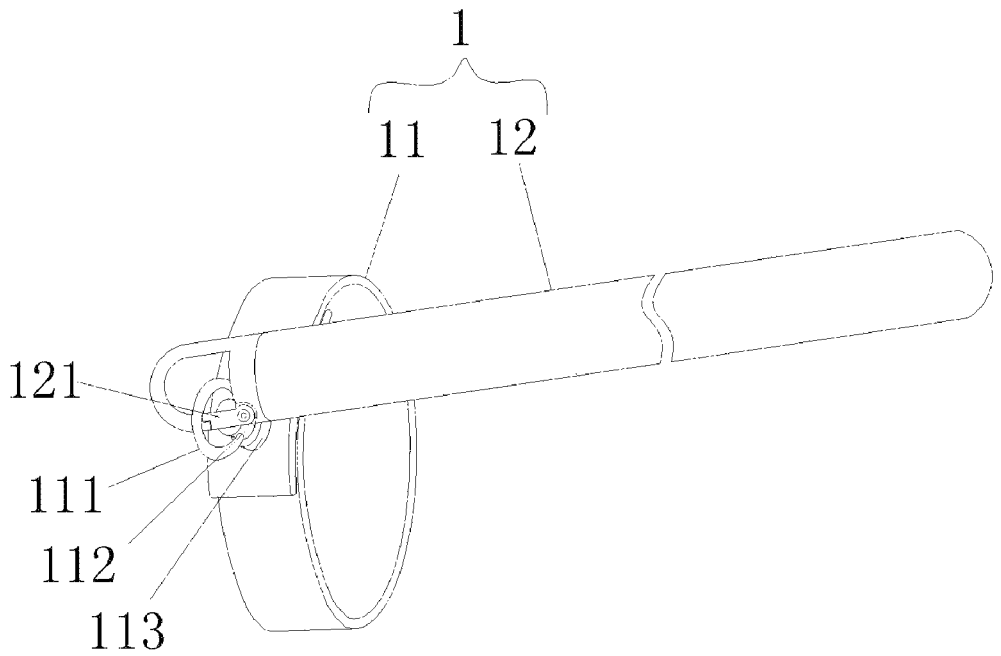
FIG. 2 is a structural schematic diagram of a hand push rod in embodiment 1.

The present embodiment provides a postoperative functional exerciser for frozen shoulder, which is used for rehabilitation exercise after arthroscopic release operations of the frozen shoulder and is especially suitable for rehabilitation exercise for the external rotation function of the shoulder joint. As shown in FIG. 1 and FIG. 2, the present embodiment comprises a hand push rod 1, a restrictive band 2 for restricting the elbow, and a waist buckle for fixing the restrictive band. The waist buckle is arranged on the waist on a side opposite to an affected arm, and specifically arranged on top of trousers of a patient. The hand push rod 1 comprises a wristband 11 and a push rod 12. One end of the push rod 12 is connected with the wristband 11. When the hand push rod 1 and the restrictive band 2 are in operation, a part of the restrictive band 2 winds around the side opposite to the affected arm and penetrates through the waist buckle, and the other part winds around the elbow joint of the affected arm. The elbow joint of the affected arm is tied to an outer side of a rib of a body. The wristband 11 is sleeved on the wrist of the affected arm.

A part of the restrictive band 2 penetrates through the waist buckle on a side of the waist of the patient, and the other part of the restrictive band 2 winds around the elbow joint or upper arm of the affected arm. The upper arm is tied to the body by means of the restrictive band 2, so that the elbow and the upper arm cling to an outer edge of the rib of the patient. In addition, the wristband 11 is sleeved on the wrist or forearm of the affected arm. The patient holds the push rod 12 through a non-affected arm and drags the wristband 11 through the push rod 12, so as to drive the forearm to swing outwards. Of course, in the present embodiment, another person can hold the push rod 12 for rehabilitation exercise.

Further, in the present invention, a waistband 4 is also arranged; the waistband 4 winds around the body and is tied to the waist; and the waistband 4 penetrates through the waist buckle 3. The waistband 4 and the restrictive band penetrate through the same waist buckle 3 to form fixation of the waistband 4 for the restrictive band. A relatively comfortable interlocking fixation structure is formed by the waistband 4, the waist buckle 3 and the restrictive band 2, so that the affected arm can be fixed to the outer rib of the body.

In the present embodiment, a buckle 121 is arranged at one end of the push rod 12; the wristband 11 is provided with a buckle ring 111; and the buckle 121 is fastened with the buckle ring 111. Specifically, one end of the push rod 12 is provided with a cavity for accommodating the buckle ring 111. Meanwhile, an opening is formed in the cavity, and the opening is closed through the buckle 121.

Figure 6:
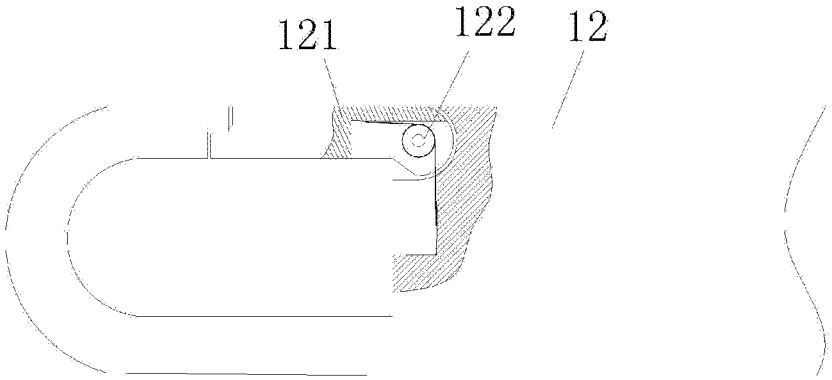
FIG. 6 is a structural schematic diagram of a push rod in embodiment 1.

As shown in FIG. 6, in a first embodiment of the buckle 121, one end of the buckle 121 is hinged with one side of the opening, and the other end of the buckle 121 is abutted against the other side of the opening. The opening limits the buckle 121 to only swing towards the cavity. A torsional spring 122 is arranged at a hinging place. The other end of the buckle 121 is kept abutted against the other side of the opening through the torsional spring 122, so that the cavity is closed, so as to prevent the buckle ring 111 from separating from the cavity after being clamped in. During use, the buckle ring 111 comes out of the buckle 121 and is pressed into the cavity; and under the action of the torsional spring 122, the buckle 121 bounces back to close the opening.

Figure 7:
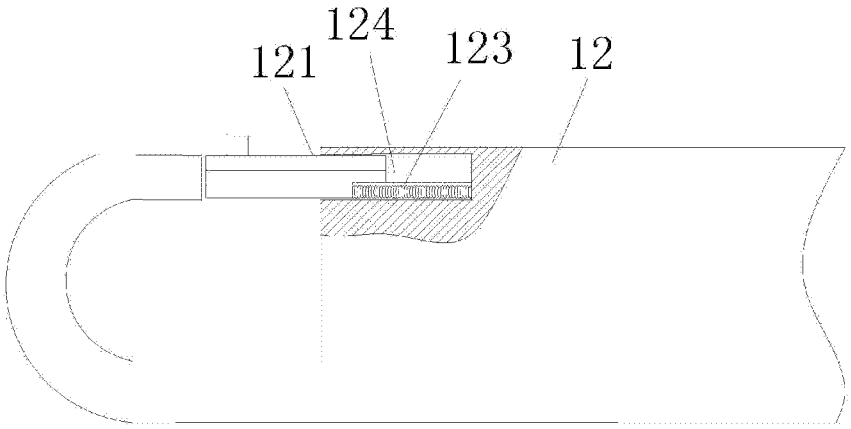
FIG. 7 is a structural schematic diagram of another implementation manner of a push rod in embodiment 1.

As shown in FIG. 7, in a second embodiment of the buckle 121, the buckle 121 is in sliding connection with the push rod 12. The push rod 12 is provided with a sliding groove 124. The sliding groove 124 is formed at one side of the opening, is axially formed along the push rod 12, and points to the other side of the opening. The buckle 121 is arranged along the sliding groove 124 in a sliding manner. A pressure spring 123 is arranged in the sliding groove 124. One end of the pressure spring 123 is fixed, and the other end is abutted against the buckle 121. The pressure spring 123 drives the buckle 121, so that the buckle 121 is abutted against the other side of the opening, to provide a driving force for the buckle 121 to bounce back to close the opening. During use, the buckle 121 is pushed by hand so that the buckle 121 moves along the sliding groove 124. At this moment, the buckle ring 111 can be clamped into the cavity from the opening; and after the buckle 121 is released by hand, the pressure spring 123 drives the buckle 121 to bounce back to close the opening.

As shown in FIG. 2 to FIG. 5, in the present embodiment, a rotating member 112 is arranged. One end of the rotating member 112 is rotatably connected with the wristband 11, and the other end is provided with an installing hole; and the buckle ring 111 is arranged in the installing hole. Specifically, one end of the rotating member 112 is provided with a disk 1121 with a diameter greater than a diameter of the rotating member 112. A rotating seat 113 is arranged. The rotating seat 113 is fixed to the wristband 11. The rotating seat 113 is provided with a rotating cavity 1131 and a circular hole which is communicated with the outside and a rotating wall. The rotating member 112 penetrates through the circular hole. The disk 1121 is formed in the rotating cavity 1131. In the present embodiment, the rotating member 112 can rotate in the rotating cavity 1131; and the buckle ring 111 can swing around the axis of the installing hole to form universal connection between the buckle ring 111 and the wristband 11, thereby avoiding mutual interference between the wristband 11 and the buckle ring 111 and facilitating the push rod 12 to draw the wristband 11 to move.

The push rod 12 comprises a plurality of telescopic sections; a head and a tail of adjacent telescopic sections can be connected flexibly; and the adjacent telescopic sections are provided with a positioning structure for positioning a telescopic state. Telescopic storage of the push rod 12 is realized through the telescopic sections, thereby shortening the storage length of the push rod 12, facilitating logistics transportation and improving the portability of the present embodiment.

The wristband 11 is of a banded structure. Both ends of the banded structure are respectively provided with buckling structures which are matched with each other. Both ends of the banded structure are connected into a ring through the buckling structures. In a non-use state, two buckling structures are in a non-connection state and the wristband 11 is not buckled into a ring. During use, the wristband 11 winds around the wrist and the two buckling structures are buckled. After buckling, the perimeter of the wristband 11 is slightly greater than the perimeter of the wrist and smaller than the perimeter of a palm. In the present embodiment, the wristband 11 can be sleeved on the wrist without slipping from the palm.

Figure 3:
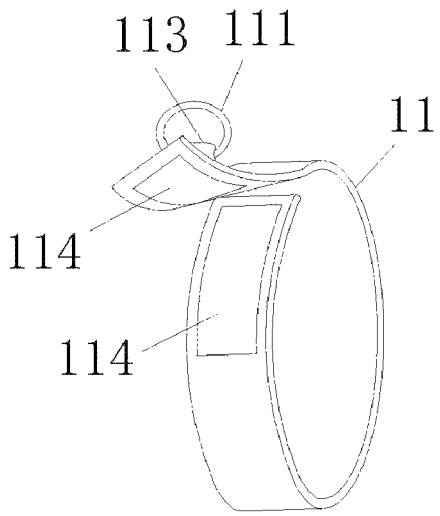
FIG. 3 is a structural schematic diagram of a wristband in embodiment 1.

As shown in FIG. 3, in the present embodiment, in an implementation manner of the buckling structures, the buckling structures are velcro 114 arranged on both ends of the banded structure respectively. The buckling of the wristband 11 in any position is realized through the velcro 114, so as to facilitate adjustment of a proper perimeter of the wristband 11, so that the wristband 11 and the wrist are adapted in sizes.

Figure 4:
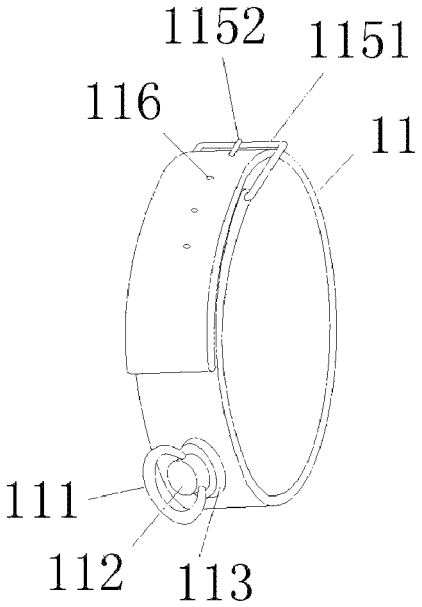
FIG. 4 is a structural schematic diagram of another implementation manner of a wristband in embodiment 1.
Figure 5:
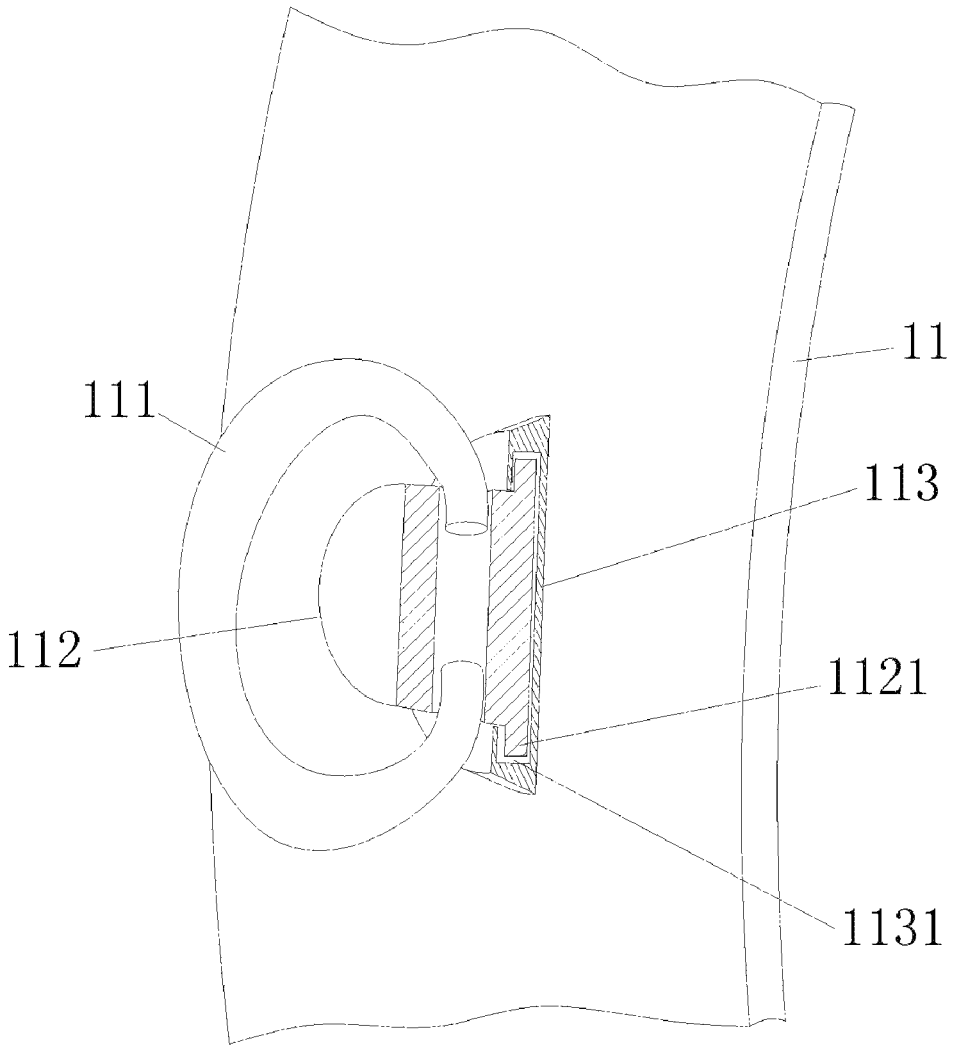
FIG. 5 is a structural schematic diagram of a buckle ring in embodiment 1.

As shown in FIG. 4, in a second embodiment of the buckling structures, the buckling structures comprise an adjusting hole 116 formed at one end of the banded structure and an adjusting buckle 115 arranged at the other end of the banded structure; and the adjusting buckle 115 is buckled in the adjusting hole 116. Specifically, the adjusting buckle 115 comprises a buckling frame 1151 and a buckling rod 1152. The buckling frame 1151 is provided with four borders, wherein the first border and the second border are arranged oppositely and the first border is fixedly connected with the other end of the banded structure. One end of the buckling rod 1152 is hinged to the first border, and the other end is abutted against the second border. During use, one end of the banded structure penetrates through the buckling frame 1151; the buckling rod 1152 penetrates through the adjusting hole and is lower than the second border; and the buckling rod 1152 is used to prevent the banded structure from being buckled loosely. Through the buckling between the adjusting hole 116 and the adjusting buckle 115, the buckling is very firm.

The banded structure is flexible material. During tying, the flexible material is difficult to damage skin. Specifically, the banded structure is leather or cloth.

The postoperative functional exerciser for frozen shoulder in the present embodiment allows ordinary patients to have the economic ability to purchase the functional exerciser of the present invention, and to carry the functional exerciser of the present invention. The present invention allows the patients to receive postoperative rehabilitation exercise of the frozen shoulder without the limitations of economic capability, time and locations, makes the special rehabilitation of shoulder joint and frozen shoulder operations possible, has far-reaching significance for the development of arthroscopic radical operation of frozen shoulder, and is of great scientific significance to enrich and improve the existing medical rehabilitation equipment and lead the technological progress of relevant research fields.

Embodiment 2

The main technical solution of the present embodiment is basically identical with the technical solution of embodiment 1 or embodiment 2. Features not explained in the present embodiment adopt the explanations in embodiment 1 or embodiment 2 and will not be repeated herein. The difference between embodiment 1 and embodiment 2 is that:

The restrictive band 2 is of a banded structure. Both ends of the banded structure are respectively provided with buckling structures which are matched with each other. Both ends of the banded structure are connected into a ring through the buckling structures. In a non-use state, two buckling structures are in a non-connection state and the restrictive band 2 is not buckled into a ring. During use, one end of the restrictive band 2 penetrates through the waist buckle 3 on the waist of the body, winds around the affected arm and then is buckled with the other end. After buckling, the restrictive band 2 is tied to the upper arm of the affected arm and clings to an outer edge of the rib of the body.

Figure 8:
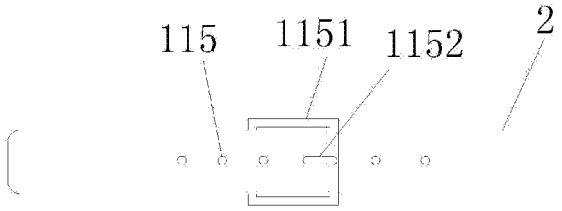
FIG. 8 is a structural schematic diagram of a restrictive band in embodiment 2.

As shown in FIG. 8, in the present embodiment, in an implementation manner of the buckling structures, the buckling structures are velcro 114 arranged on both ends of the banded structure respectively. The buckling of the restrictive band 2 in any position is realized through the velcro 114, so as to facilitate adjustment of a proper perimeter of the restrictive band 2, so that the restrictive band 2 and the body of the patient are adapted in sizes.

Figure 9:
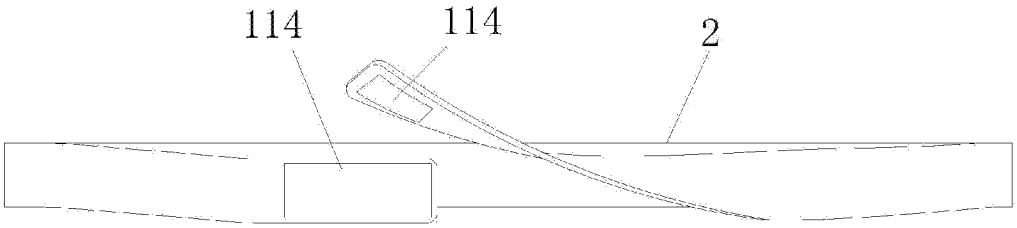
FIG. 9 is a structural schematic diagram of another implementation manner of a restrictive band in embodiment 2.

As shown in FIG. 9, in a second embodiment of the buckling structures, the buckling structures comprise an adjusting hole 116 formed at one end of the banded structure and an adjusting buckle 115 arranged at the other end of the banded structure; and the adjusting buckle 115 is buckled in the adjusting hole 116. Specifically, the adjusting buckle 115 comprises a buckling frame 1151 and a buckling rod 1152. The buckling frame 1151 is provided with four borders, wherein the first border and the second border are arranged oppositely and the first border is fixedly connected with the other end of the banded structure. One end of the buckling rod 1152 is hinged to the first border, and the other end is abutted against the second border. During use, one end of the banded structure penetrates through the buckling frame 1151; the buckling rod 1152 penetrates through the adjusting hole and is lower than the second border; and the buckling rod 1152 is used to prevent the banded structure from being buckled loosely. Through the buckling between the adjusting hole 116 and the adjusting buckle 115, the buckling is very firm.

The banded structure is flexible material. During tying, the flexible material is difficult to damage skin. Specifically, the banded structure is leather or cloth.

The above only describes specific preferred embodiments of the present invention, but the protection scope of the present invention is not limited to this. Changes or replacements which can be easily contemplated by any of those skilled in the art within the technical scope disclosed in the present invention shall be covered in the protection scope of the present invention. Therefore, the protection scope of the present invention shall depend on the protection scope of claims.

What is claimed is:

1. A postoperative functional exerciser for frozen shoulder, comprising a hand push rod, a restrictive band for restricting the elbow, and a waist buckle for fixing the restrictive band; wherein the waist buckle is configured to be arranged on the waist on a side opposite to an affected arm; the hand push rod comprises a wristband and a push rod; one end of the push rod is connected with the wristband; the restrictive band is circular the restrictive band penetrates through the waist buckle and is configured to surround a patient's back, the elbow joint of the affected arm, and the patient's belly to tie the elbow joint of the affected arm on the patient's body; and the wristband is configured to be sleeved on the wrist of the affected arm.

2. The postoperative functional exerciser for frozen shoulder according to claim 1, wherein a waistband is arranged; the waistband is configured to wind around the body and is configured to be tied to the waist; and the waistband penetrates through the waist buckle.

3. The postoperative functional exerciser for frozen shoulder according to claim 1, wherein the push rod is provided with a buckle; the wristband is provided with a buckle ring; and the buckle is fastened with the buckle ring.

4. The postoperative functional exerciser for frozen shoulder according to claim 3, wherein a rotating member is arranged; a first end of the rotating member is rotatably connected with the wristband, and a second end is provided with an installing hole; and the buckle ring is arranged in the installing hole.

5. The postoperative functional exerciser for frozen shoulder according to claim 1, wherein the wristband is of a banded structure; both ends of the banded structure are respectively provided with buckling structures which are matched with each other; and both ends of the banded structure are connected into a ring through the buckling structures.

6. The postoperative functional exerciser for frozen shoulder according to claim 1, wherein the restrictive band is of a banded structure; both ends of the banded structure are respectively provided with buckling structures which are matched with each other; and both ends of the banded structure are buckled into a ring through the buckling structures.

7. The postoperative functional exerciser for frozen shoulder according to claim 5, wherein the buckling structures are hook and loop arranged on both ends of the banded structure respectively.

8. The postoperative functional exerciser for frozen shoulder according to claim 6, wherein the buckling structures are hook and loop arranged on both ends of the banded structure respectively.

9. The postoperative functional exerciser for frozen shoulder according to claim 5, wherein the buckling structures comprise an adjusting hole formed at a first end of the banded structure and an adjusting buckle arranged at a second end of the banded structure; and the adjusting buckle is buckled in the adjusting hole.

10. The postoperative functional exerciser for frozen shoulder according to claim 6, wherein the buckling structures comprise an adjusting hole formed at a first end of the banded structure and an adjusting buckle arranged at a second end of the banded structure; and the adjusting buckle is buckled in the adjusting hole.

11. The postoperative functional exerciser for frozen shoulder according to claim 5, wherein the banded structure is made of flexible material.

12. The postoperative functional exerciser for frozen shoulder according to claim 6, wherein the banded structure is made of flexible material.

13. The postoperative functional exerciser for frozen shoulder according to claim 1, wherein the push rod comprises a plurality of telescopic sections; adjacent telescopic sections are connected end to end; and the adjacent telescopic sections are provided with a positioning structure for positioning a telescopic state.

* * * * *